US012258054B2

(12) United States Patent
Na et al.

(10) Patent No.: US 12,258,054 B2
(45) Date of Patent: Mar. 25, 2025

(54) EARLY WARNING PROTECTION SYSTEM BASED ON BEIDOU POSITION AUTOMATIC SENSING

(71) Applicant: CASCO SIGNAL LTD., Shanghai (CN)

(72) Inventors: Jiqing Na, Shanghai (CN); Jiajia Cheng, Shanghai (CN); Tao Wang, Shanghai (CN); Zhixin Chen, Shanghai (CN)

(73) Assignee: CASCO SIGNAL LTD., Shanghai (CN)

( * ) Notice: Subject to any disclaimer, the term of this patent is extended or adjusted under 35 U.S.C. 154(b) by 718 days.

(21) Appl. No.: 17/596,087

(22) PCT Filed: Oct. 19, 2020

(86) PCT No.: PCT/CN2020/121818
§ 371 (c)(1),
(2) Date: Dec. 2, 2021

(87) PCT Pub. No.: WO2021/218056
PCT Pub. Date: Nov. 4, 2021

(65) Prior Publication Data

US 2022/0242464 A1 Aug. 4, 2022

(30) Foreign Application Priority Data

Apr. 29, 2020 (CN) ..... 202010356827.1

(51) Int. Cl.
*B61L 15/00* (2006.01)
*B61L 23/06* (2006.01)
(Continued)

(52) U.S. Cl.
CPC ..... *B61L 15/0018* (2013.01); *B61L 23/06* (2013.01); *B61L 25/021* (2013.01); *B61L 25/025* (2013.01); *B61L 25/04* (2013.01)

(58) Field of Classification Search
CPC .... B61L 15/0018; B61L 23/06; B61L 25/021; B61L 25/035; B61L 25/04
See application file for complete search history.

(56) References Cited

U.S. PATENT DOCUMENTS

2022/0242464 A1* 8/2022 Na ..... B61L 25/025

FOREIGN PATENT DOCUMENTS

CN 207216026 U 4/2018
CN 108263444 A * 7/2018
(Continued)

OTHER PUBLICATIONS

International Search Report (with English translation) and Written Opinion issued in PCT/CN2020/121818, dated Jan. 27, 2021.

*Primary Examiner* — Jason C Smith
(74) *Attorney, Agent, or Firm* — HSML P. C.

(57) ABSTRACT

The present invention relates to an early warning protection system based on Beidou position automatic sensing, the system is in communication connection with a TDCS/CTC system, and the early warning protection system includes a locomotive train-mounted terminal subsystem, a ground early warning protection platform subsystem, and a handheld terminal subsystem, the ground early warning protection platform subsystem is in communication connection to the TDCS/CTC system, the locomotive train-mounted terminal subsystem, and the handheld terminal subsystem respectively; and the ground early warning protection platform subsystem performs judgment processing on train-to-train and train-to-person early warning logics according to Beidou positioning, a train speed, and train direction information provided by the locomotive train-mounted terminal
(Continued)

subsystem and Beidou positioning information of the hand-held terminal subsystem and with reference to station information and train number information sent by the TDCS/CTC system and line data and data of a virtual transponder, and forwards processed early warning information to the locomotive train-mounted terminal subsystem and the hand-held terminal subsystem. Compared with the prior art, the present invention has the advantages of implementing early warning and protection for railway construction personnel, a train, and the like.

12 Claims, 6 Drawing Sheets

(51) Int. Cl.
*B61L 25/02* (2006.01)
*B61L 25/04* (2006.01)

(56) References Cited

FOREIGN PATENT DOCUMENTS

| | | | | | |
|---|---|---|---|---|---|
| CN | 105691418 | B | * | 8/2018 | |
| CN | 108609035 | A | * | 10/2018 | ..... B61L 23/06 |
| CN | 109677463 | A | | 4/2019 | |
| CN | 110435718 | A | * | 11/2019 | |
| CN | 209617163 | U | | 11/2019 | |
| CN | 111391890 | A | | 7/2020 | |
| CN | 115331392 | A | * | 11/2022 | |
| CN | 218141564 | U | * | 12/2022 | |
| CN | 115641690 | A | * | 1/2023 | |
| CN | 116580592 | A | * | 8/2023 | |
| CN | 117585039 | A | * | 2/2024 | |
| CN | 220465509 | U | * | 2/2024 | |
| CN | 117799666 | A | * | 4/2024 | |
| CN | 118205597 | A | * | 6/2024 | |
| CN | 118310771 | A | * | 7/2024 | |

* cited by examiner

EARLY WARNING PROTECTION SYSTEM BASED ON BEIDOU POSITION AUTOMATIC SENSING

FIELD OF TECHNOLOGY

The present invention relates to an early warning protection system, and in particular, to an early warning protection system based on Beidou position automatic sensing.

BACKGROUND

With the opening and operation of high-speed railway in China, the research on improving train operation safety and resolving a signal system fault has entered a new development stage.

On May 1, 2012, the former Ministry of Railways conducted a field test of a high-speed railway train tracking approach early warning system in Beijing-Shanghai High-speed Railway. On May 27, test devices were installed on two test EMUs of Hanyi line for long-term function test. The high-speed railway train tracking approach early warning system has an obvious test effect and has an early warning tracking function, but training positioning information and information transmission policy used by the system still uses en existing railway signal technology, that is, train positioning is implemented by using a track circuit.

Southwest Jiaotong University proposed a train early warning system based on a radar technology. The system acquires image information at a fixed distance by using a radar technology, compares the image information with an image stored in a database, and analyzes a road condition ahead to improve a sight distance of a driver to play an early warning role.

The following manners are mainly adopted for train positioning in China: track circuit positioning, satellite navigation positioning, axle counter positioning, an inductive line train-mounted sensor, map matching positioning, speed measurement positioning, wireless positioning, query transponder positioning, train positioning based on wireless communication, and the like. According to analysis of positioning, safety performance of a track circuit and an axle counter are relatively high, but the accuracy is poor; the query transponder has relatively high accuracy but needs a large quantity of auxiliary devices with poor mobility; the inductive line positioning can avoid the interference of a traction current and greatly improve the anti-interference capability of a positioning system, but requires a large quantity of cables and heavy maintenance workload in the later stage; and the speed measurement positioning, the wireless positioning, the map matching positioning, and the satellite positioning have relatively good mobility, but also have respective shortcomings, the error accumulation of speed integration caused by the speed measurement positioning leads to the reduction of the accuracy, the reliability of the wireless positioning needs to be further improved, the satellite positioning is greatly affected by the environment, and the map matching positioning requires high accuracy of a matched digital map.

In China, collision accident prevention is mainly based on a train control system and relies on technical means such as a track circuit and a radio block, which can meet requirements of train protection. The protection of railway field workers has always been a disadvantage in the field of railway safety. Currently, early warning protection cannot be performed for the collision protection of the field workers through technical means.

SUMMARY

The purpose of the present invention is to provide an early warning protection system based on Beidou position automatic sensing to overcome defects in the prior art.

The purpose of the present invention may be achieved through the following technical solutions.

An early warning protection system based on Beidou position automatic sensing is provided, the system being in communication connection with a TDCS/CTC system, where the early warning protection system includes a locomotive train-mounted terminal subsystem, a ground early warning protection platform subsystem, and a handheld terminal subsystem, the ground early warning protection platform subsystem is in communication connection to the TDCS/CTC system, the locomotive train-mounted terminal subsystem, and the handheld terminal subsystem respectively.

The ground early warning protection platform subsystem performs judgment processing on train-to-train and train-to-person early warning logics according to Beidou positioning, a train speed, and train direction information provided by the locomotive train-mounted terminal subsystem and Beidou positioning information of the handheld terminal subsystem and with reference to station information and train number information sent by the TDCS/CTC system as well as line data and data of a virtual transponder, and forwards processed early warning information to the locomotive train-mounted terminal subsystem and the handheld terminal subsystem.

Preferably, the ground early warning protection platform subsystem includes a center communication server and an early warning protection processing server, a TDCSi interface server, a 4G communication interface server, a maintenance platform, and a satellite positioning base station management server that are respectively connected to the center communication server, the TDCSi interface server is in communication connection to the TDCS/CTC system, and the 4G communication interface server is in communication connection to the locomotive train-mounted terminal subsystem and the handheld terminal subsystem respectively.

Preferably, the ground early warning protection platform subsystem further includes a satellite short message command aircraft and a satellite positioning base station that are connected to the satellite positioning base station management server.

Preferably, the locomotive train-mounted terminal subsystem includes a train-mounted terminal main control board and a train-mounted terminal 4G communication module, a train-mounted terminal Beidou positioning module, a train-mounted terminal power supply module, a network data module, a serial port data module, and a DMI display that are respectively connected to the train-mounted terminal main control board.

Preferably, the locomotive train-mounted terminal subsystem further includes a train-mounted terminal 4G communication antenna connected to the train-mounted terminal 4G communication module and a train-mounted terminal Beidou receiving antenna connected to the train-mounted terminal Beidou positioning module.

Preferably, the handheld terminal subsystem includes a handheld terminal main control board and a handheld terminal 4G communication module, a handheld terminal Beidou positioning module, a handheld terminal power supply module, an I/O module, and a data storage module that are respectively connected to the handheld terminal main control board.

Preferably, the handheld terminal subsystem further includes a handheld terminal 4G communication antenna connected to the handheld terminal 4G communication module and a handheld terminal Beidou receiving antenna connected to the handheld terminal Beidou positioning module.

Preferably, the early warning protection system not only can implement early warning protection between a train and a construction personnel but also can implement approach early warning between a train and a train.

Preferably, the early warning protection system has different early warning modes for different protected objects of a construction personnel or a train.

Preferably, the different early warning modes specifically include:

(1) a construction personnel early warning mode, where the construction personnel working on site is taken as a main protection object, the construction personnel is taken as a center, and an emergency distance, an early warning distance, and an approach distance are divided before and after a current position of the construction personnel;

(2) a train early warning mode, where a traveling train is taken as a main protection object, and an emergency distance, an early warning distance, and an approach distance are divided before and after a current position of the train;

(3) a station early warning mode, where a construction personnel in a station inputs information about a construction start time, a construction end time, and a construction start position and end position in the handheld terminal subsystem according to a construction operation arrangement, then the system automatically sets and virtually locks a related protection region, and performs early warning protection for a distance approaching to a train and the virtually locked protection region, and an emergency distance, an early warning distance, and an approach distance are divided before and after the virtually locked protection region;

(4) an interval construction personnel early warning mode, where a construction personnel in an interval manually inputs information about a construction start time, a construction end time, and a construction start position and end position in the handheld terminal subsystem according to a construction operation arrangement, then the system automatically sets and virtually locks a related protection region, and performs early warning protection for a distance approaching to a train and the virtually locked protection region, the construction personnel is taken as a main protection object, and an emergency distance, an early warning distance, and an approach distance are divided before and after the virtually locked protection region where the construction personnel is located; and (5) an interval train early warning mode, where distances between a protected train and a front train and between the protected train and a rear train are determined logically, the protected train is taken as a center, and an early warning distance, and an approach distance are divided before and after a current position of the train.

Compared with the prior art, the present invention has the following advantages:

(1) In the present invention, high-precision positioning and short message communication technology provided by a domestic independent Beidou No. 3 system is first applied to a train early warning system by using a wireless communication technology. Position information of a train and a construction personnel is tracked according to Beidou positioning information, operation track information of the train and the construction personnel is sent to a comprehensive early warning protection platform in real time by using the wireless communication technology, and automatic early warning of collision is implemented according to the position information and the operation tracks, thereby achieving early warning protection on the train construction personnel and trains.

(2) In the present invention, information exchange between the train as well as the construction personnel and a ground early warning protection center server is implemented by using a 4G wireless communication technology based on an APN private network, and meanwhile, positioning of a terminal and information transmission in a 4G communication blind area are implemented based on a Beidou satellite positioning and short message technology. In the present invention, station code bit information of a station and an interval is obtained from the TDCS/CTC system with reference to the TDCS/CTC system, to implement position tracking of the train by using a multiple positioning technology combining a track circuit and satellite positioning. In the present invention, it not only can resolve early warning protection between trains, but also can implement early warning protection between locomotive and construction personnel.

DESCRIPTION OF THE EMBODIMENTS

Clear and complete description will be made to the technical solutions in embodiments of the present invention in conjunction with drawings in the embodiments of the present invention hereafter. Obviously, the described embodiments are merely a part of embodiments of the present invention and not all the embodiments. Based on the embodiments of the present invention, all of other embodiments obtained by a person of ordinary skill in the art without any creative effort shall belong to the protection scope of the present invention.

Figure 1:
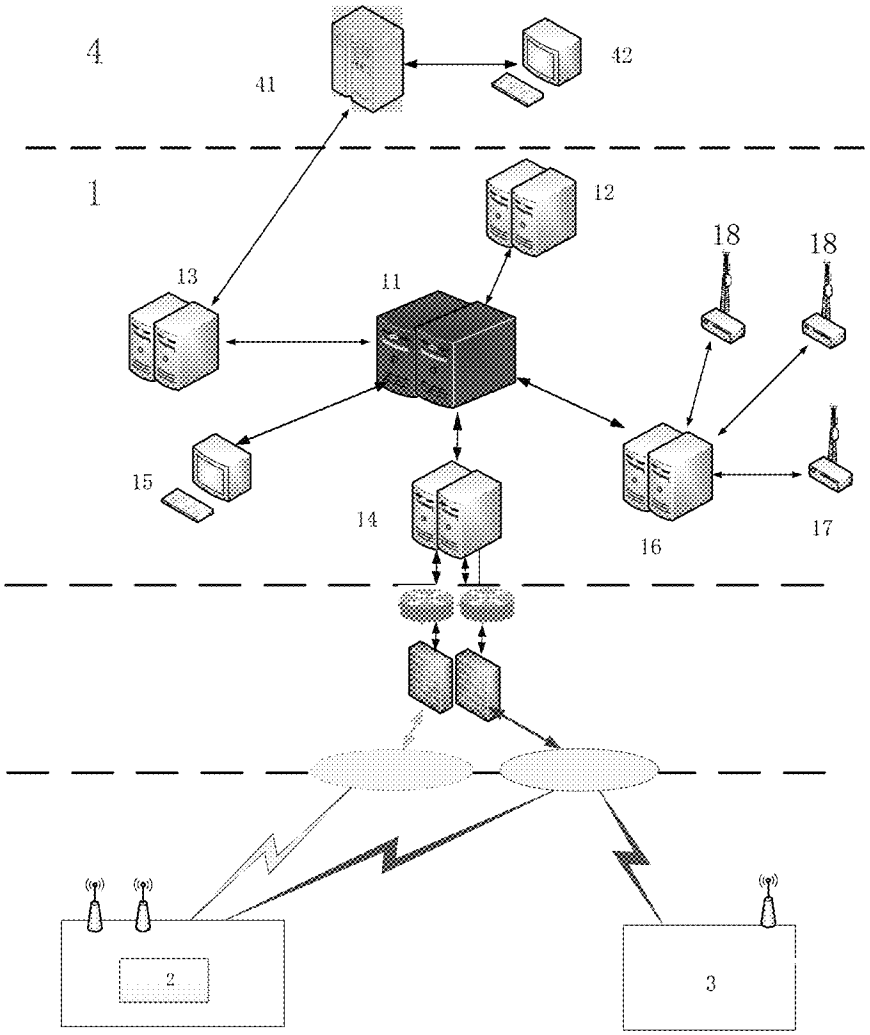
FIG. 1 is a schematic structural diagram of the present invention.

As shown in FIG. 1, an early warning protection system based on Beidou position automatic sensing is provided, the system being in communication connection with a TDCS/CTC system 4, where the early warning protection system includes a locomotive train-mounted terminal subsystem 2, a ground early warning protection platform subsystem 1, and a handheld terminal subsystem 3, the ground early warning protection platform subsystem 1 is in communication connection to the TDCS/CTC system 4, the locomotive train-mounted terminal subsystem 2, and the handheld terminal subsystem 3 respectively. The TDCS/CTC system 4 includes a TDCS/CTC interface machine 41 and an LMT 42.

The ground early warning protection platform subsystem performs judgment processing on train-to-train and train-to-person early warning logics according to Beidou positioning, a train speed, and train direction information provided by the locomotive train-mounted terminal subsystem and Beidou positioning information of the handheld terminal subsystem and with reference to station information and train number information sent by the TDCS/CTC system as well as line data and data of a virtual transponder, and forwards processed early warning information to the locomotive train-mounted terminal subsystem and the handheld terminal subsystem.

The ground early warning protection platform subsystem 1 includes a center communication server 11 and an early warning protection processing server 12, a TDCSi interface server 13, a 4G communication interface server 14, a maintenance platform 15, and a satellite positioning base station management server 16 that are respectively connected to the center communication server 11, the TDCSi interface server 13 is in communication connection to the TDCS/CTC interface machine 41 of the TDCS/CTC system 4, and the 4G communication interface server 14 is in communication connection to the locomotive train-mounted terminal subsystem 2 and the handheld terminal subsystem 3 respectively. The ground early warning protection platform subsystem 1 further includes a satellite short message command aircraft 17 and a satellite positioning base station 18 that are connected to the satellite positioning base station management server 16.

Figure 2:
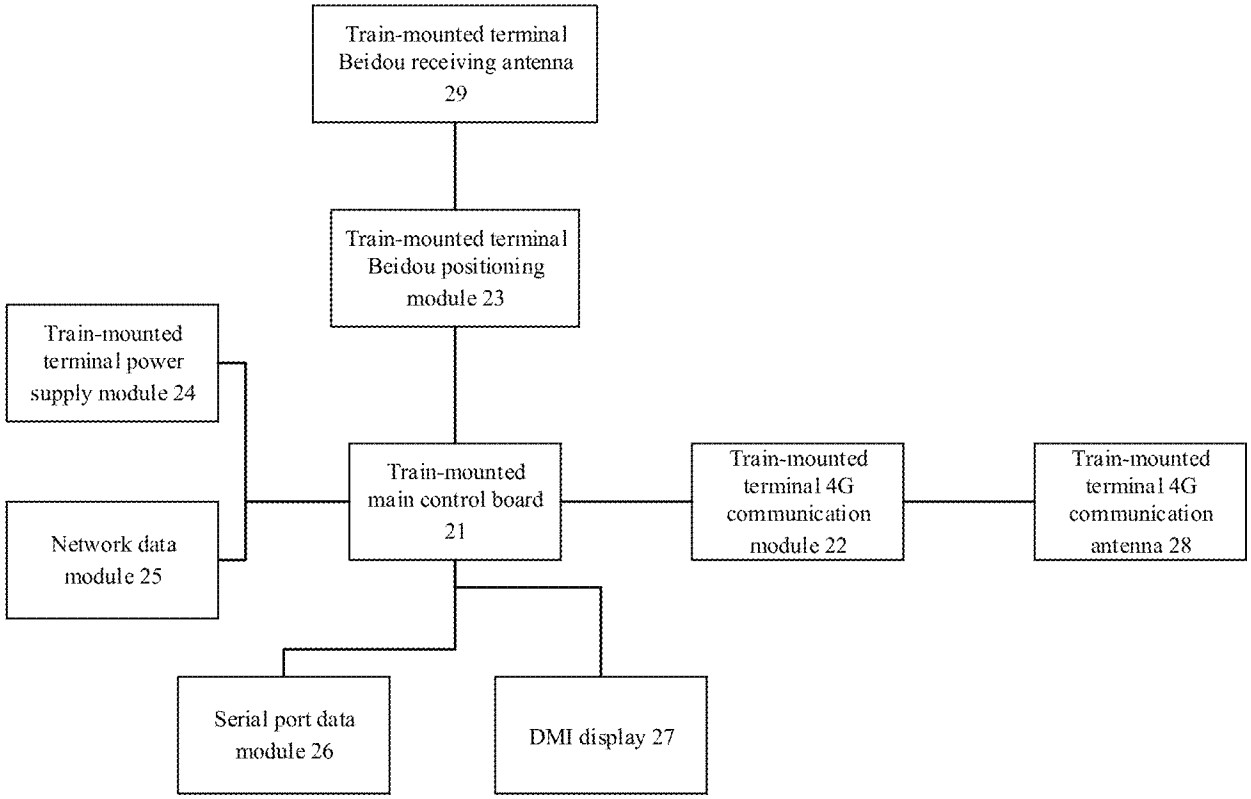
FIG. 2 is a schematic structural diagram of a locomotive train-mounted terminal subsystem of the present invention.

As shown in FIG. 2, the locomotive train-mounted terminal subsystem 2 includes a train-mounted terminal main control board 21 and a train-mounted terminal 4G communication module 22, a train-mounted terminal Beidou positioning module 23, a train-mounted terminal power supply module 24, a network data module 25, a serial port data module 26, and a DMI display 27 that are respectively connected to the train-mounted terminal main control board 21. The locomotive train-mounted terminal subsystem 2 further includes a train-mounted terminal 4G communication antenna 28 connected to the train-mounted terminal 4G communication module 22 and a train-mounted terminal Beidou receiving antenna 29 connected to the train-mounted terminal Beidou positioning module 23.

Figure 3:
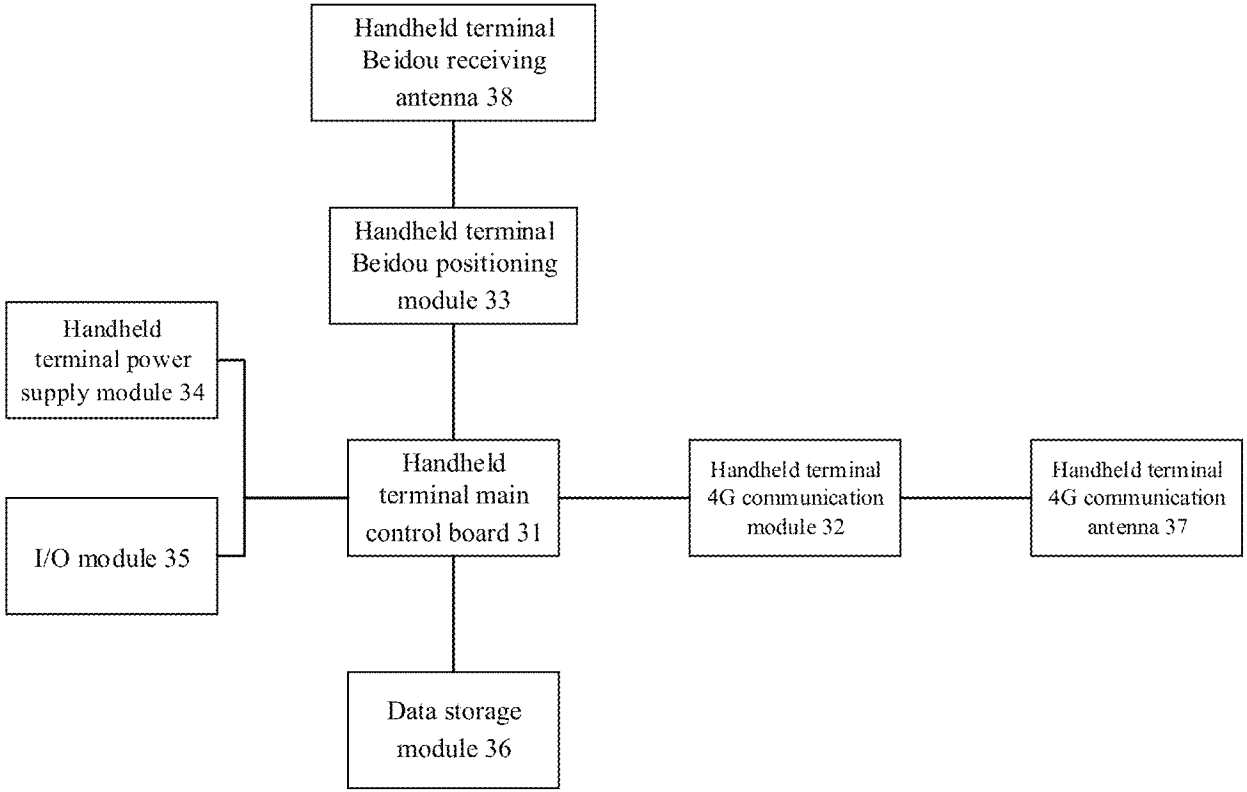
FIG. 3 is a schematic structural diagram of a handheld terminal subsystem of the present invention.

As shown in FIG. 3, the handheld terminal subsystem 3 includes a handheld terminal main control board 31 and a handheld terminal 4G communication module 32, a handheld terminal Beidou positioning module 33, a handheld terminal power supply module 34, an I/O module 35, and a data storage module 36 that are respectively connected to the handheld terminal main control board 31. The handheld terminal subsystem 3 further includes a handheld terminal 4G communication antenna 37 connected to the handheld terminal 4G communication module 32 and a handheld terminal Beidou receiving antenna 38 connected to the handheld terminal Beidou positioning module 33.

The early warning protection system based on Beidou position automatic sensing performs judgment processing on train-to-train and train-to-person early warning logics according to Beidou positioning information, speed information, and direction information of a train-mounted terminal of a train and a handheld terminal of a construction personnel and with reference to station information and train number information sent by the TDCS/CTC system as well as line data and data of a virtual transponder, and forwards processed early warning information to the train-mounted terminal of the train and the handheld terminal of the personnel, and then a terminal device forecasts the early warning information to the construction personnel.

The early warning protection system not only can implement early warning protection between a train and a construction personnel but also can implement approach early warning between a train and a train. The early system has different early warning modes for different protected objects of a construction personnel or a train.

(1) Construction Personnel Early Warning Mode

Figure 4:
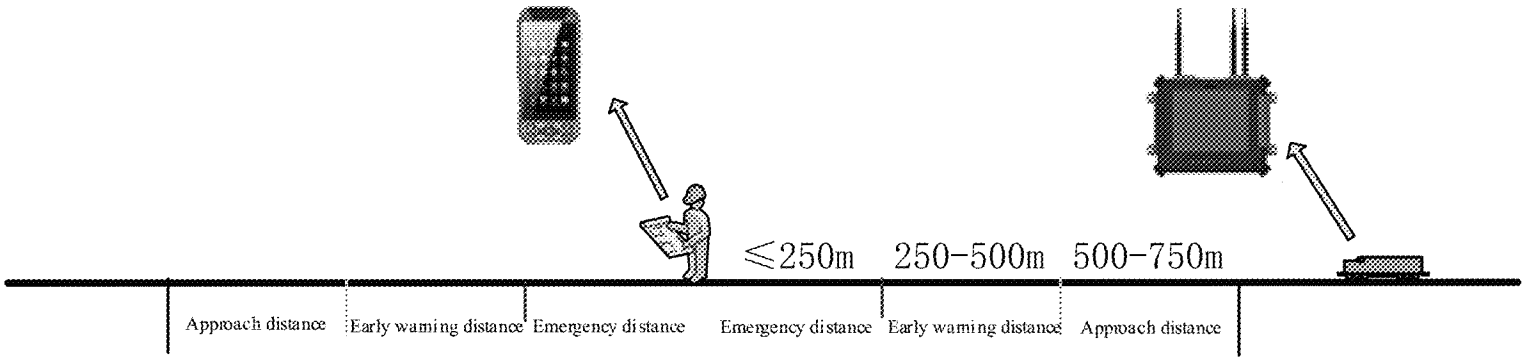
FIG. 4 is a schematic diagram of a construction personnel early warning mode.

In the construction personnel early warning mode, the construction personnel working on site is taken as a main protection object, the construction personnel is taken as a center, and an emergency distance (a distance≤250 m), an early warning distance (250 m<a distance≤500 m), and an approach distance (500 m<a distance≤750 m) are divided before and after a current position of the construction personnel, as shown in FIG. 4.

(2) Train Early Warning Mode

The early warning protection system does not have a train completeness detection function, and requires a driver to manually input train length information in the train-mounted terminal.

Figure 5:
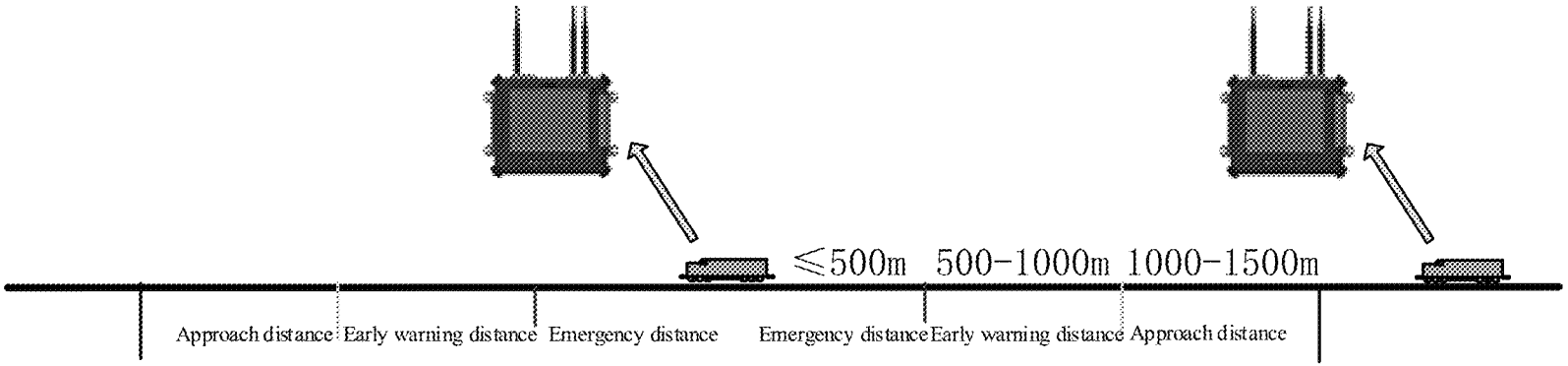
FIG. 5 is a schematic diagram of a train early warning mode.

In the train early warning mode, a traveling train is taken as a main protection object, and an emergency distance(a distance≤500 m), an early warning distance (500 m<a distance≤1000 m), and an approach distance (1000 m<a distance≤1500 m) are divided before and after a current position of the train, as shown in FIG. 5.

(3) Station Early Warning Mode

The early warning protection system turns off an early warning information prompt function for the train in the station and performs train approach early warning protection only on the construction personnel in the station.

Figure 6:
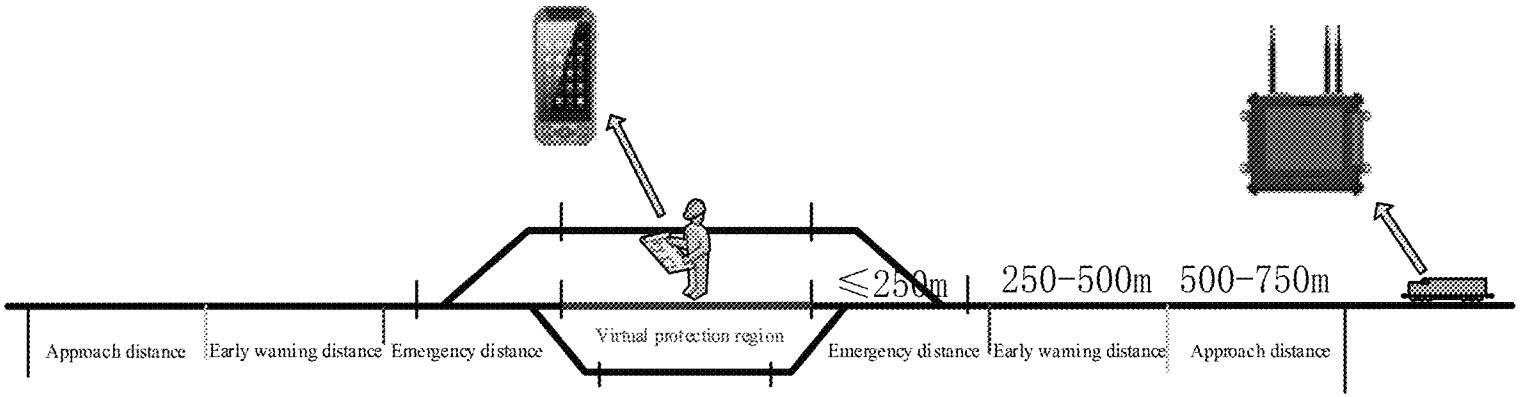
FIG. 6 is a schematic diagram of a station early warning mode.

The construction personnel in the station manually inputs information about a construction start time, a construction end time, and a construction start position and end position in the handheld terminal subsystem according to a construction operation arrangement, then the system automatically sets and virtually locks the related protection region, and performs early warning protection for a distance approaching to a train and a virtually locked protection region. Because the station is provided with a plurality of protection measures such as a track circuit, train number information, and a signal machine, a train traveling speed is slow, and an emergency distance (a distance≤250 m), an early warning distance (250 m<a distance≤500 m), and an approach distance (500 m<a distance≤750 m) are divided before and after the virtually locked protection region, as shown in FIG. 6.

(4) Interval Early Warning Mode

The early warning protection system not only can implement early warning protection between a train and a construction personnel in an interval but also can implement approach early warning between a train and a train in the interval.

Interval Construction Personnel Early Warning Mode

The construction personnel in the interval manually inputs information about a construction start time, a construction end time, and a construction start position and end position in the handheld terminal subsystem according to a construction operation arrangement, then the system automatically sets and virtually locks a related protection region, and performs early warning protection for a distance approaching to a train and the virtually locked protection region.

Figure 7:
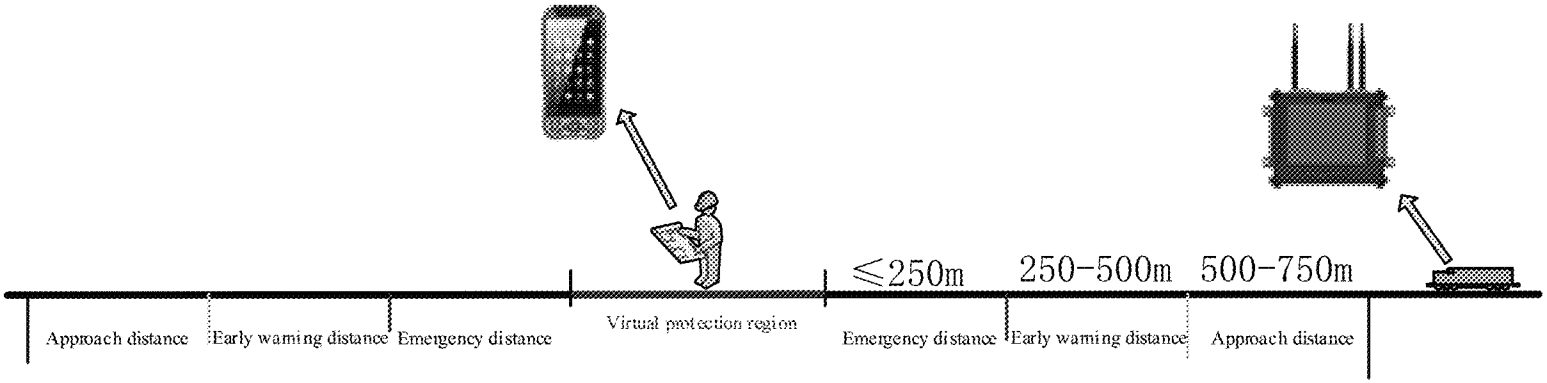
FIG. 7 is a schematic diagram of an interval construction personnel early warning mode.

The construction personnel is taken as a main protection object, and an emergency distance (a distance≤250 m), an early warning distance (250 m<a distance≤500 m), and an approach distance (500 m<a distance≤750 m) are divided before and after the virtually locked protection region where the construction personnel is located, as shown in FIG. 7.

Interval Train Early Warning Mode

Figure 8:
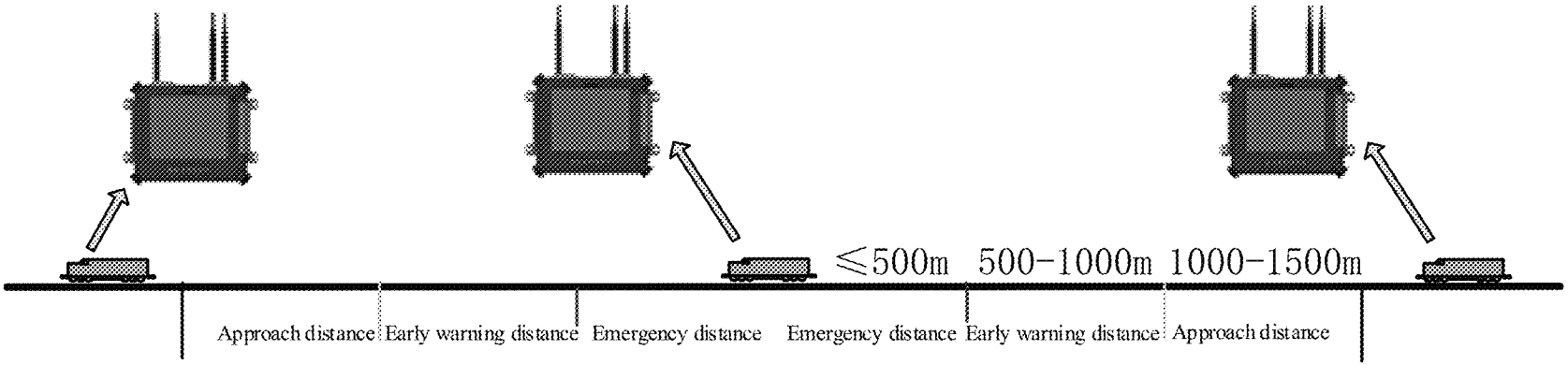
FIG. 8 is a schematic diagram of an interval train early warning mode.

The train traveling in the interval has a relatively high speed, the early warning protection system logically determines distances between a protected train and a front train and between the protected train and a rear train according to information such as a train traveling speed, a direction, and an operation track, the protected train is taken as a center, and an emergency distance(a distance≤500 m), an early warning distance (500 m<a distance≤1000 m), and an approach distance (1000 m<a distance≤1500 m) are divided before and after a current position of the train, as shown in FIG. 8.

In the present invention, the system has the following technical innovations:

1. Satellite Positioning

Beidou/GPS dual mode positioning is used.

Position information of a train and a construction personnel is accurately calculated through satellite positioning.

Communication is performed by using a Beidou short message in a case that wireless communication fails, to ensure the continuity of communication.

2. Application of a 4G Virtual Private Network Technology in an Early Warning System An IP-based virtual private network is used as a communication mode between a train and the ground and between a terminal and a ground center.

A design of two sets of 4G communication modules of different modes is used.

Data transmission safety is ensured by using an APN private network technology.

The above descriptions are only specific implementations of the present invention. However, the protection scope of the present invention is not limited thereto, any person skilled in the art can easily think of various equivalent modifications or substitutions within the technical scope disclosed by the present invention, and all of these modifications or substitutions shall fall within the protection scope of the present invention. Therefore, the protection scope of the present invention should be determined with reference to the appended claims.

What is claimed is:

1. An early warning protection system based on Beidou position automatic sensing, the system being in communication connection with a TDCS/CTC system, wherein the early warning protection system comprises a locomotive train-mounted terminal subsystem, a ground early warning protection platform subsystem, and a handheld terminal subsystem, the ground early warning protection platform subsystem is in communication connection to the TDCS/CTC system, the locomotive train-mounted terminal subsystem, and the handheld terminal subsystem respectively; and the ground early warning protection platform subsystem performs judgment processing on train-to-train and train-to-person early warning logics according to Beidou positioning, a train speed, and train direction information provided by the locomotive train-mounted terminal subsystem and Beidou positioning information of the handheld terminal subsystem and with reference to station information and train number information sent by the TDCS/CTC system as well as line data and data of a device, and forwards processed early warning information to the locomotive train-mounted terminal subsystem and the handheld terminal subsystem, wherein the ground early warning protection platform subsystem comprises a center communication server and an early warning protection processing server, a TDCSi interface server, a 4G communication interface server, a maintenance platform, and a satellite positioning base station management server that are respectively connected to the center communication server, the TDCSi interface server is in communication connection to the TDCS/CTC system, and the 4G communication interface server is in communication connection to the locomotive train-mounted terminal subsystem and the handheld terminal subsystem respectively, wherein the ground early warning protection platform subsystem further comprises a satellite device and a satellite positioning base station that are connected to the satellite positioning base station management server, wherein the early warning protection system has different early warning modes for different protected objects of a construction personnel or a train, wherein the different early warning modes specifically comprise:

(1) a construction personnel early warning mode, wherein the construction personnel working on site is taken as a main protection object, the construction personnel is taken as a center, and an emergency distance, an early warning distance, and an approach distance are divided before and after a current position of the construction personnel;

(2) a train early warning mode, wherein a traveling train is taken as a main protection object, and an emergency distance, an early warning distance, and an approach distance are divided before and after a current position of the train;

(3) a station early warning mode, wherein a construction personnel in a station inputs information about a construction start time, a construction end time, and a construction start position and end position in the handheld terminal subsystem according to a construction operation arrangement, then the system automatically sets a related protection region, and performs early warning protection for a distance approaching to a train and the protection region, and an emergency distance, an early warning distance, and an approach distance are divided before and after the protection region;

(4) an interval construction personnel early warning mode, wherein a construction personnel in an interval manually inputs information about a construction start time, a construction end time, and a construction start position and end position in the handheld terminal subsystem according to a construction operation arrangement, then the system automatically sets a related protection region, and performs early warning protection for a distance approaching to a train and the protection region, the construction personnel is taken as a main protection object, and an emergency distance, an early warning distance, and an approach distance are divided before and after the protection region where the construction personnel is located; and (5) an interval train early warning mode, wherein distances between a protected train and a front train and between the protected train and a rear train are determined logically, the protected train is taken as a center, and an early warning distance, and an approach distance are divided before and after a current position of the train, wherein information exchange between the train as well as the construction personnel and a ground early warning protection center server is implemented by using a 4G wireless communication based on an APN private network, positioning of a terminal and information transmission in a 4G communication blind area are implemented based on a Beidou satellite positioning and short message, station information of a station and an interval is obtained from the TDCS/CTC system, position tracking of the train is implemented by using a multiple positioning combining a track circuit and satellite positioning, early warning protection between trains is implemented, and early warning protection between locomotive and the construction personnel is implemented.

2. The early warning protection system based on Beidou position automatic sensing according to claim 1, wherein the locomotive train-mounted terminal subsystem comprises a train-mounted terminal main control board and a train-mounted terminal 4G communication module, a train-mounted terminal Beidou positioning module, a train-mounted terminal power supply module, a network data module, a serial port data module, and a DMI display that are respectively connected to the train-mounted terminal main control board.

3. The early warning protection system based on Beidou position automatic sensing according to claim 2, wherein the locomotive train-mounted terminal subsystem further comprises a train-mounted terminal 4G communication antenna connected to the train-mounted terminal 4G communication module and a train-mounted terminal Beidou receiving antenna connected to the train-mounted terminal Beidou positioning module.

4. The early warning protection system based on Beidou position automatic sensing according to claim 1, wherein the handheld terminal subsystem comprises a handheld terminal main control board and a handheld terminal 4G communication module, a handheld terminal Beidou positioning module, a handheld terminal power supply module, an I/O module, and a data storage module that are respectively connected to the handheld terminal main control board.

5. The early warning protection system based on Beidou position automatic sensing according to claim 4, wherein the handheld terminal subsystem further comprises a handheld terminal 4G communication antenna connected to the handheld terminal 4G communication module and a handheld terminal Beidou receiving antenna connected to the handheld terminal Beidou positioning module.

6. The early warning protection system based on Beidou position automatic sensing according to claim 1, wherein the early warning protection system not only can implement early warning protection between a train and a construction personnel but also can implement approach early warning between a train and a train.

7. The early warning protection system based on Beidou position automatic sensing according to claim 1, wherein position information of the train and the construction personnel is determined through Beidou and GPS dual-mode positioning.

8. The early warning protection system based on Beidou position automatic sensing according to claim 7, wherein communication is performed by using a Beidou short message when wireless communication fails, to ensure the continuity of communication.

9. The early warning protection system based on Beidou position automatic sensing according to claim 8, further comprising a 4G virtual private network.

10. The early warning protection system based on Beidou position automatic sensing according to claim 9, further comprising an IP-based virtual private network configured to be a communication mode between the train and the ground and between a terminal and a ground center.

11. The early warning protection system based on Beidou position automatic sensing according to claim 10, further comprising two sets of 4G communication modules of different modes.

12. The early warning protection system based on Beidou position automatic sensing according to claim 11, further comprising an APN private network for data transmission safety.

* * * * *